United States Patent [19]

Zakon

[11] 3,950,957

[45] Apr. 20, 1976

[54] THERMODYNAMIC INTERLINKAGE OF AN AIR SEPARATION PLANT WITH A STEAM GENERATOR

[76] Inventor: Tsadok Zakon, 10, Mapu Ave., Ahuza, Haifa, Israel

[22] Filed: May 6, 1974

[21] Appl. No.: 467,252

Related U.S. Application Data

[63] Continuation-in-part of Ser. No. 196,940, Nov. 9, 1971, abandoned.

[30] Foreign Application Priority Data

Apr. 30, 1971 Israel ..... 36741

[52] U.S. Cl. ..... 62/30; 62/13; 62/39; 62/38; 60/648

[51] Int. Cl.[2] ..... F25J 13/02

[58] Field of Search ..... 62/27–29, 62/31, 38, 39, 13, 34, 36, 9, 11, 23

[56] References Cited

UNITED STATES PATENTS

| | | | |
|---|---|---|---|
| 2,520,862 | 8/1950 | Swearingen | 62/38 |
| 3,194,026 | 7/1965 | LaFleur | 62/38 |
| 3,260,057 | 7/1966 | Becker | 62/28 |
| 3,340,697 | 9/1967 | Cimler et al. | 62/29 |
| 3,531,942 | 10/1970 | LaFleur | 62/23 |
| 3,731,495 | 5/1973 | Coveney | 62/13 |

OTHER PUBLICATIONS

"Thermodynamics for Chemical Engineers", Weber & Meissner, 2nd Ed., John Wiley & Sons, 1957.

*Primary Examiner*—Norman Yudkoff
*Assistant Examiner*—Frank Sever
*Attorney, Agent, or Firm*—Depaoli & O'Brien

[57] ABSTRACT

An air separation plant operates at elevated pressures and with reflux to produce an oxygen product and a nitrogen product which is indirectly heat exchanged with the compressed main air feed therefor to produce a hot nitrogen product.

The air separation plant is interlinked with a steam generator by indirectly exchanging high-grade heat from the flue gases to the hot nitrogen product to form a very hot nitrogen product, by work-expanding the very hot nitrogen product, and by indirectly exchanging lower-grade heat from the work-expanded nitrogen product to the heated fluids of the steam generator so that compression heat is recovered as mechanical energy, the temperature distribution in the steam generator is improved to diminish irreversibility of heat exchange within the steam generator and increase total efficiency of the interlinked plants, and the nitrogen product is uncontaminated and recoverable.

28 Claims, 4 Drawing Figures

THERMODYNAMIC INTERLINKAGE OF AN AIR SEPARATION PLANT WITH A STEAM GENERATOR

CROSS-REFERENCE TO RELATED APPLICATION

This application is a continuation-in-part of co-pending application Ser. No. 196,940, filed Nov. 9, 1971, now abandoned.

BACKGROUND OF THE INVENTION

1. Field of the Invention

The invention relates to the fractionation of air at low temperatures and elevated pressures into oxygen and nitrogen and additionally relates to thermal power plants. The invention more particularly relates to means for economizing of energy by recovery of compression energy and especially relates to such recovery by interlinking of an air separation plant with a thermal power plant.

2. Review of the Prior Art

In recent years some reduction in energy requirements has been achieved by operating the fractionating column of an air separation plant at elevated pressures, as described for example in U.S. Pat. No. 976,352 (Ruhemann and Putman) and British Pat. No. 1,180,904 (Smith). Efforts have also been made to recover part of the energy required for the fractionation of air by extracting a quantity of nitrogen-rich vapour from the fractionating column at a superatmospheric pressure, heating the vapour, and mixing it with hot combustion gases, or enriching it with oxygen and burning fuel within it, to form a hot waste gas which is work-expanded in a gas turbine. A regenerator or waste heat boiler is then used to absorb part of the heat remaining in the waste gas after its expansion in the gas turbine, as described in U.S. Pat. Nos. 2,520,862 (Swearingen) and 3,731,495 (Coveney).

However, this combination of air separation plant products with hot combustion gases permits only slight economic advantages to be achieved because:

a considerable amount of nitrogen beacomes unavailable as commercial product;

the oxygen recovery is reduced, requiring larger compressors and gas turbines and additional fuel for the gas turbine operation to obtain the required quantity of oxygen;

a considerable amount of the heat generated by the compression of the air is wasted; and the waste gas has to leave the waste gas boiler or the regenerator at a fairly high temperature because of the danger of corrosion attack on the equipment of the waste gas boiler or regenerator.

SUMMARY OF THE INVENTION

It is the object of the present invention to recuperate almost all the energy required for the compression of air before its fractionation.

It is another object to recover not only the oxygen, but also most of the nitrogen from the air.

It is an additional object to use the nitrogen product with a small oxygen content for the recuperation of the compression energy even when the fractionation is carried out at elevated pressures.

In this description, the following terms are used: High pressure — a pressure higher than 9 ata, but lower than 25 ata. Intermediate pressure — a pressure higher than 1.5 ata, but lower than 9 ata. Fractionating column — a fractionating column which includes two fractionating zones, such as fractionating stages, the zones not necessarily being stacked one atop the other, one of these zones operating at a high pressure and the other operating at an intermediate pressure. Nitrogen product — nitrogen-rich vapour extracted from the upper part of the intermediate pressure zone. Oxygen product — oxygen-rich fluid extracted from the bottom of the intermediate pressure zone. Heat accumulator — reversible heat exchanger of Fraenkl type, but suitable for relatively high temperatures.

In the fractionating column, the oxygen-rich liquid from the bottom of the high pressure zone is used as feed for the intermediate pressure zone, and the nitrogen-rich liquid from the top of the high pressure zone is used as reflux for the intermediate and high pressure zones. At least one condenser is provided which is not necessarily disposed within the fractionating column and in which the oxygen-rich liquid from the intermediate pressure zone is evaporated, thus cooling and condensing the nitrogen-rich vapour from the top of the high pressure zone.

In accordance with these objects and the spirit of this invention, almost all the heat which is generated by compression of the incoming air, before its separation, is reconverted back into mechanical energy by "exchanging" the relatively low-grade heat of compression for an essentially equal amount of high-grade heat, in order to make possible such a reconversion.

It has been discovered that this reconversion can be achieved by interlinking an air separation plant operating at elevated pressures with a steam generator, and it has been further discovered that because of the very wide range of temperatures at which a steam generator operates, its efficiency need not be affected by this exchange of the low-grade heat of the compressed air for the high-grade heat of the flue gases. This exchange causes heat to be displaced or moved from one area of a thermal power plant, such as a steam generating plant, to another without losing the availability of the heat for producing mechanical energy. The exchange is effected by using the nitrogen product of the air separation plant as the vehicle for such movement by adding high-temperature heat of the steam generator to compression heat of the air separation plant, subtracting work-expansion energy therefrom, and finally transferring residual low-temperature heat back to the steam generator without impairing its efficiency, without contamination of the nitrogen product by other gases, and without corrosion or condensation damage to the auxiliary equipment of the steam generator.

The characteristic features of this interlinking are as follows:

On the part of the air separation plant:

The main air stream is compressed with a little waste of the heat generated by compression, and preferably without intercooling, to a pressure above 9 ata, imparts a substantial part of its heat of compression to the nitrogen product, is further cooled to or slightly above its dew point, and enters the fractionating process. The nitrogen product is extracted from the top of the intermediate pressure zone of the fractionating column at a pressure lower than 9 ata, warmed by the incoming air feed to ambient temperature, and heated by the incoming air feed further in such a temperature range that it absorbs a substantial part of the heat of compression. The nitrogen product is heated subsequently by the flue gases in an indirect heat exchange to a temperature well above 600°C., expands in a gas turbine, and imparts most of its heat remaining after such expansion to the heated fluids of the steam generator, such as steam, water, and air for combustion of fuel.

On the part of the steam generator:

To the nitrogen product, the flue gases impart heat at high temperature levels and are used further for the generation of steam. The heated fluids of the steam generator are deprived of an amount of heat at high temperature levels that is thus imparted, but simultaneously they obtain an amount of heat at relatively lower temperature levels from the nitrogen product after its expansion in the gas turbine.

Throughout all the heat exchanges, the flue gases and the nitrogen product form separate gas streams, isolated mechanically from each other, and do not mix with each other. Thus, the nitrogen product remains in pure conditon and retains its commercial value. Furthermore, being a dry and non-corrosive gas, the nitrogen product can leave the steam generator at nearly ambient temperature without the danger of corrosion attack on the components of the steam generator.

Removing heat at high temperature levels and imparting heat at relatively lower temperature levels involves degradation of heat and ordinarily should cause per se loss of efficiency. However, in some thermal plants, e.g., steam generators, the temperature distribution is such that when these plants are deprived of a quantity of heat at high temperature levels and simultaneously are supplied with the same quantity of heat at relatively lower temperature levels, their efficiency need not be affected. Thus, the flue gases may have, after combustion of fuel, a temperature of, say, 2,500°C., while the highest steam temperature achieved up to now is about 600° – 650°C. The nitrogen product is heated according to the invention by the flue gases to a temperature well above 600°C., say to 1,290°C. If the flue gases, after heating the nitrogen product, have a temperature of about 2,000°C. and the nitrogen product, after its expansion, is still at 880°C., then the heat remaining in the flue gases can nevertheless be sufficient for steam generation and superheating, while the heat remaining in the nitrogen product, after its expansion, can still be used for the generation of steam and/or heating the feed water and air for combustion of fuel.

This feasibility of exchanging the high temperature heat for relatively lower temperature heat in a steam generator without affecting its efficiency is increased by the fact that, even in the most advanced steam cycles, about 70% of the heat is taken in at or below the saturation temperature of steam. As the saturation temperature of steam must be lower than 374°C. (its critical point), it is obvious that the generation of steam need not be impaired because of heating the nitrogen product by the flue gases and because of the reduction of its heat content (and temperature) when work-expanding in the gas turbine.

Thus, the effect of the heat-exchange relations according to the invention is that the nitrogen product absorbs a substantial part of the heat of compression of the air to be separated (which is a relatively low-grade heat), then absorbs further an amount of the high-grade heat from the flue gases, expands in a gas turbine, and returns to the steam generator the low-grade heat, without impairing the efficiency of the steam generator. The work performed by the gas turbine is thus greatly increased by making use, according to the invention, of the temperature distribution in the steam generator.

The nitrogen product can be heated by the flue gases, before the flue gases impart their heat further to the heated fluids of the steam generator, by several means, for example: (a) in a heat exchanger made of heat-resisting materials, (b) in a pebble heater, or (c) in an internally fired gas heater.

a. When a relatively small volume of the nitrogen product is heated by the flue gases in a heat exchanger made of heat-resisting material, the heat exchanger can be disposed in the fire space of the steam generator, provided the steam generator itself is of large size. Otherwise, the heat exchanger has to be located outside the steam generator.

b. When the nitrogen product is heated in a pebble heater, the pebble heater can be installed in front of the steam generator and thus large air separation plants can be dealt with. However, as the nitrogen product is heated in compressed condition, the pebble heater has to be pressurized and the steam generator, to which the flue gases pass from the pebble heater, preferably has to be of a supercharged type. c. When the nitrogen product is heated in an internally fired gas heater, the complications of (a) and (b) are avoided. However, an internally fired gas heater for the quantities of gas encountered in modern large air separation plants and for heat exchanges at rather high temperatures will be large and expensive.

In a preferred embodiment of the invention, air is compressed without intercooling, and while most of its heat of compression is imparted to the nitrogen product, the rest of the heat of compression is used for preheating the air for combustion of fuel.

A further feature of the invention is the relatively high degree of separation within the air separation plant which is achieved at elevated pressures by improving the reflux conditions in the intermediate pressure zone. The amount of reflux for that zone is increased by branching off a part of the nitrogen product, compressing it to a pressure at least slightly above the pressure of the high pressure zone, and leading the pressurized part of the nitrogen product into the condenser space, where it is condensed and serves as supplementary reflux for the intermediate pressure zone. Furthermore, the partial evaporation of the feed and reflux for the intermediate pressure zone, when throttling these liquids from the high pressure zone to the intermediate pressure zone, is minimized, or preferably entirely eliminated. This is achieved by extracting at least a part of the oxygen product in liquid phase, throttling it to a suitable lower pressure, and using it for adequate subcooling of the feed and reflux for the intermediate pressure zone.

Further details of the invention are shown in the drawings, each illustrating the invention in terms of an example.

EXAMPLE 1

Figure 1:
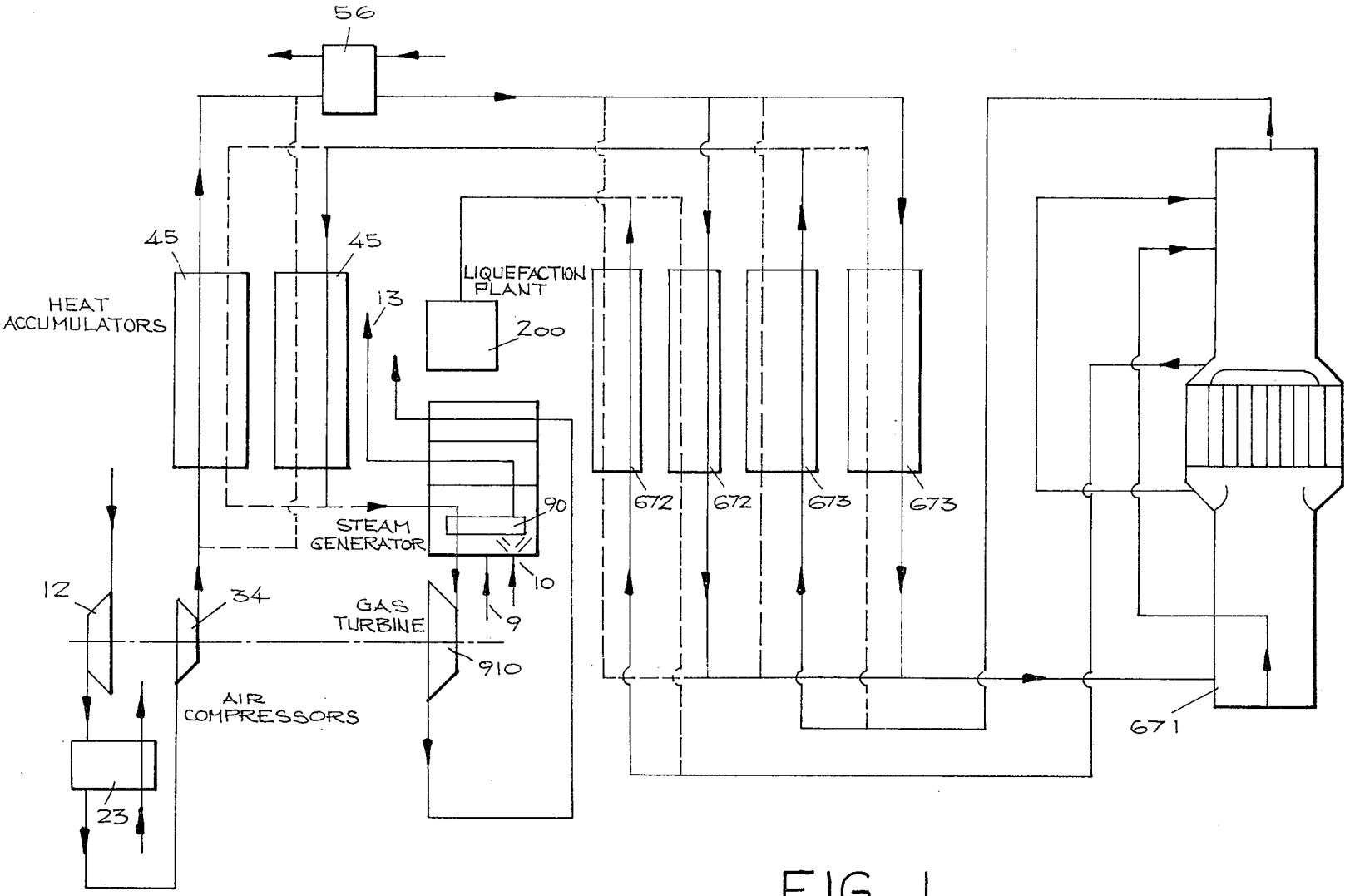
FIG. 1 is a schematic layout of an air separation plant interlinked with a steam generator. In this embodiment of the invention, the air is compressed with some intercooling.

Referring to FIG. 1, the main air feed, after its purification from dust, moisture, carbon dioxide, and the like, (the apparatus for this purification is not shown in FIG. 1), is compressed in compressor 12, cooled in cooler 23, compressed further in compressor 34, is cooled by the separated nitrogen product in the heat accumulators 45, is further cooled in the cooler 56 to the ambient temperature, and is additionally cooled in the cold accumulators 672 and 673 by outgoing oxygen and nitrogen streams, respectively. From the cold accumulators 672 and 673, the cold main air feead is led to the fractionating column 671.

The separated oxygen and nitrogen products are extracted from the fractionating column 671, led to the cold accumulators 672 and 673, respectively, and emerge from cold accumulators 672 and 673 at ambient temperature and superatmospheric pressure. The separated oxygen product proceeds from the cold accumulator 672 to the liquefaction plant 200. The separated nitrogen product is heated by the incoming compressed main air feed in the heat accumulator 45.

It is then led into the heat exchanger 90, which in this particular example is disposed within the combustion space of the steam generator 89, where it receives additional heat from the flue gases. From steam generator 89, the nitrogen product proceeds to the gas turbine 910, where it expands, producing mechanical energy. From the gas turbine 910, the nitrogen product is again led into the steam generator 89 where it imparts a substantial part of its remaining heat to the boiler water, to the steam, and to the air to be used for combustion of fuel in the steam generator 89. Air and fuel enter the steam generator 89 through conduits 9 and 10, respectively, and the flue gases, formed by combustion of the fuel, impart heat at high temperature levels to the nitrogen product in the heat exchanger 90, generate steam, and escape into the atmosphere through conduit 13.

As the separated nitrogen product is a dry and noncorrosive gas, it not only can expand in the gas turbine 910 from rather high temperatures, but it also can leave the steam generator 89 at relatively low temperatures without danger of corrosion to the components of the steam generator 89. The flue gases and the nitrogen product are mechanically isolated from each other and do not mix throughout all the heat exchanges, and, therefore, the nitrogen product remains in its pure condition and retains its commercial value.

EXAMPLE 2

Figure 2:
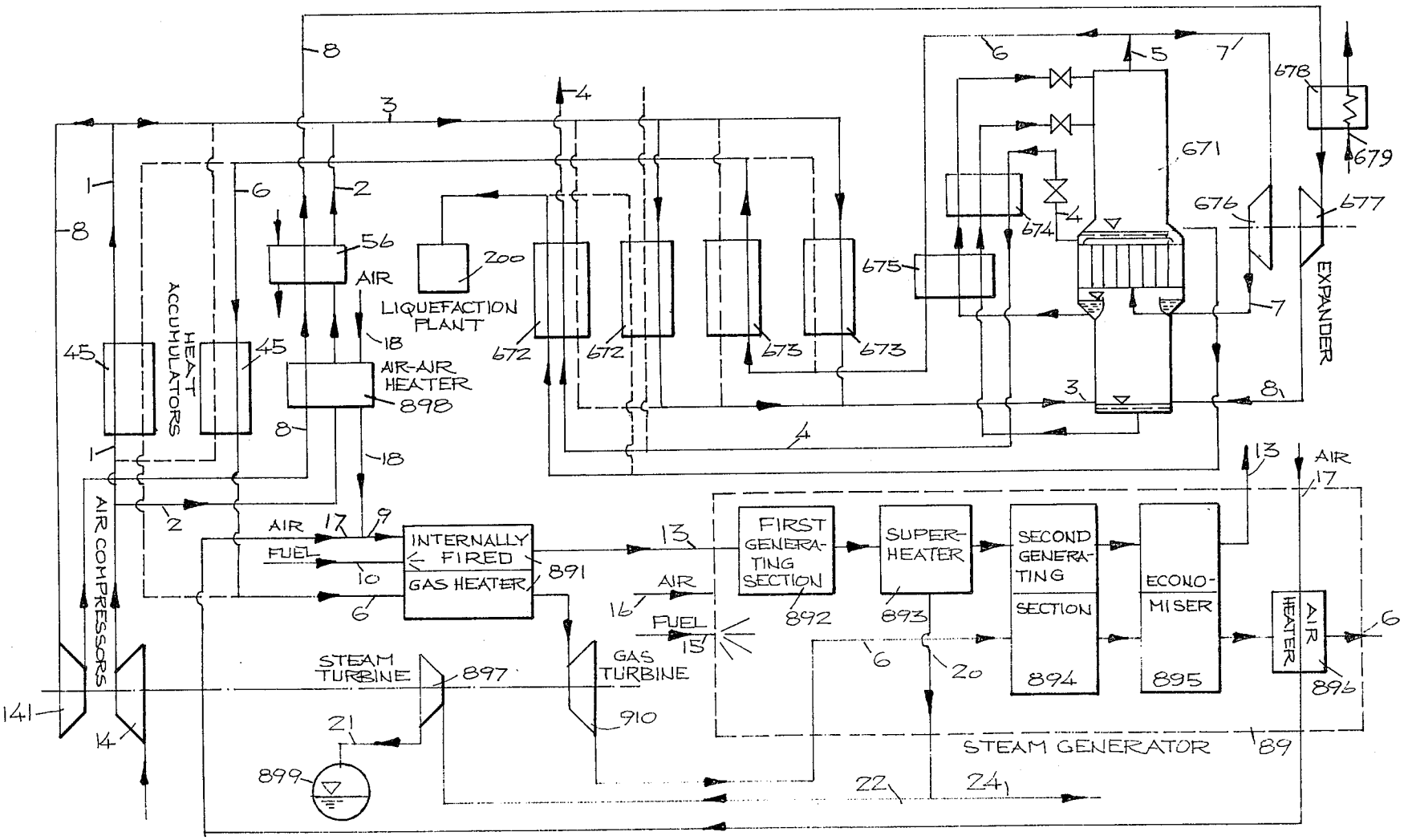
FIG. 2 is a detailed elaboration of FIG. 1 in which a relatively high degree of separation is achieved when fractionating air at elevated pressures. In this embodiment of the invention, the air is compressed without intercooling, and the nitrogen product is heated by the flue gases of an internally fired gas heater.

Referring to FIG. 2, the main air feed, after its purification from dust, moisture, carbon dioxide, and the like (the apparatus for this purification is not shown in FIG. 2), is compressed in compressor 14 to 15.5 ata without intercooling and is thus heated to 400°C. The hot compressed main air feed is then divided into two unequal streams: the major stream is led through conduit 1 to the heat accumulator 45, where it imparts its heat to the compressed nitrogen product emerging from the cold accumulators 673, and the minor stream is led through conduit 2 to the air-air heater 898, where it imparts its heat to a part of the combustion air entering the internally fired gas heater 891 through conduit 18.

In the heat accumulator 45 and in the air-air heater 898, the incoming compressed hot air feed imparts almost all the heat generated by its compression in the compressor 14 to the nitrogen product and to the part of the combustion air for the internally fired gas heater 891. The major stream of the compressed main air feed is at ambient temperature when it leaves the heat accumulator 45 through conduit 1. After removal of a small quantity through conduit 8, this major stream continues through conduit 3. The minor stream of the compressed main air feed passes through a conduit 2 from the air-air heater 898 at a temperature of about 38°C to the cooler 56, where it is cooled to 25°C, and subsequently combines with the major stream of the compressed main air feed in conduit 3. In certain cases, cooler 56 may be dispensed with, and then the temperature of the combined streams is slightly increased. The combined streams of the main air feed enter the cold accumulators 672 and 673 through conduit 3. In the cold accumulators 672 and 673, the main air feed is cooled to somewhat above its dew point and then enters the bottom of fractionating column 671 through conduit 3. The high pressure zone of column 671 operates at 15.0 ata and the intermediate pressure zone operates at 5.0 ata.

In order to achieve oxygen and nitrogen product of relatively high purity, the reflux ratio in the intermediate pressure zone of the fractionating column 671 is increased by the following procedures:

As the first procedure, part of the oxygen product is extracted in liquid phase from the bottom of the intermediate pressure zone through conduit 4, throttled from 5 ata to 1.1 ata to reduce its temperature, and brought into heat exchange with the feed and reflux to the intermediate pressure zone in the second subcooler 674, in which the feed and reflux are subcooled to 98°K and 94°K, respectively. This subcooling of feed and reflux practically eliminates partial evaporation of the feed and reflux when they are throttled from 15 ata to 5 ata into the intermediate pressure zone of the fractionating column 671.

As the second procedure in order to increase still further the reflux ratio in the intermediate pressure zone of column 671, the nitrogen product, extracted from the top of the intermediate pressure zone through conduit 5, is divided into two streams: the major stream is led through conduit 6 to the first subcooler 675 and subsequently to the cold accumulators 673 and heat accumulators 45. The minor stream is led through conduit 7 to the nitrogen compressor 676, where it is compressed to a pressure slightly higher than 15 ata, and is subsequently introduced into the condenser space of the high pressure zone of the column 671, where it condenses and constitutes additional reflux for the intermediate pressure zone of column 671.

Increasing the reflux quantity to the intermediate pressure zone of the fractionating column 671 makes it possible to achieve nitrogen product of relatively high purity, and thus good oxygen recovery, at the operating pressures of 15 ata and 5 ata in fractionating column 671, and constitutes one of the basic differences between the present invention and Coveney's method (U.S. Pat. No. 3,731,495), where nitrogen-rich vapour with relatively high oxygen content has to be removed from the intermediate pressure zone to enable the extraction of relatively pure products when the fractionation of air is carried out at elevated pressures.

As stated hereinbefore, a small quantity of air branches off from the conduit 1 after the heat accumulator 45 as refrigerating cycle air and passes through conduit 8 to the refrigerating cycle air compressor 141 wherein it is compressed to 150 ata. This highly compressed refrigerating cycle air then passes through conduit 8 to the air-air heater 898 where it imparts most of the heat of its compression to a part of the combustion air entering air-air heater 898 through conduit 18. The partially cooled refrigerating cycle air continues through conduit 8 to cooler 56 where it further cools to about 25°C. The refrigerating cycle air then moves through conduit 8 to the Freon cooler 678 where it is cooled to 217°K by the coil 679. After exit from cooler 678, the refrigerating cycle air passes through conduit 8 to the expander 677 wherein it expands, producing mechanical energy to drive the compressor 676. When leaving the expander 677, the refrigerating cycle air is at a pressure slightly above 15 ata and finally moves through conduit 8 to the high pressure zone of the fractionating column 671 in order to supplement the feed thereto in conduit 3. If as stated hereinabove, cooler 56 is omitted, the Freon cooler 678 will have to produce slightly more refrigeration.

The major nitrogen product stream, hereinafter termed the nitrogen product, leaves the cold accumulators 673 at ambient temperature through conduit 6 and enters the heat accumulator 45, wherein it is heated to 397°C, thus absorbing a substantial part of the heat generated by the compression of the air in compressor 14. The nitrogen product then passes through conduit 6 to the internally fired gas heater 891, where it is heated further to about 1,290°C by the flue gases of gas heater 891.

After leaving the internally fired gas heater 891, the nitrogen product expands in the gas turbine 910, thereby producing almost all the power required to drive the compressors 14 and 141. After its expansion, the nitrogen product passes successively to the second generating section 894, to the economiser 895, and to the air heater 896 of the steam generator 89. The inlet temperatures of the nitrogen product to the second generating section 894, economiser 895, and air-heater 896 are 880°C, 670°C, and 168°C respectively. The nitrogen product leaves the steam generator 89 through conduit 6 at 60°C., and it thus uses a substantial part of the heat generated by the compression of the air in compressors 14 and 141 for production of mechanical energy and for generation of steam.

The flue gases generated in the internally fired gas heater 891 are obtained by burnign fuel entering this heater through conduit 10 in the air entering the heater through conduit 9. The air in conduit 9 is composed of two streams: the major combustion air stream, entering through conduit 17 into the air heater 896 of the steam generator 89, and the minor combustion air stream, entering through conduit 18 into the air-air heater 898, where it is heated by the compressed main air feed from conduit 2 and by the further compressed refrigerating cycle air from conduit 8. Thus, the combustion air absorbs in the air-air heater 898 part of the heat generated by compression of the incoming air, and it absorbs also in the air heater 896 the low-grade heat remaining in the nitrogen product after the nitrogen product leaves the economiser 895.

From the internally fired gas heater 891, the flue gases are led through conduit 13 to the steam generator 89, where they impart their heat to the heated fluids of the steam generator 89 in the first generating section 892, in the superheater 893, in the second generating section 894, and in the economizer 895. The inlet temperatures of the flue gases to the first generating section 892, superheater 893, second generating section 894, and economiser 895 are 1,760°C., 1,150°C., 660°C., and 320°C., respectively, and the inlet temperatures of the expanded nitrogen product at the second generating section 894, the economiser 895, and the air heater 896 are 880°C., 670°C., and 168°C., respectively.

The steam generator 89 is similar to the one designed by the German Babcock & Wilcox Co. (type VNS 62/515); if not interlinked with an air separation plant as described hereinbefore, its inlet flue gas temperatures should be 2,180°C., 1,150°C., and 659°C., for the generating banks, superheater, and economiser, respectively. (In the non-interlinked steam generator, the combustion air is heated by steam).

Thus, it is clear that by interlinking an air separation plant with a steam generator according to this invention, the temperature differeances between the heating and heated fluids in the steam generator are considerably reduced, and, therefore, the irreversibility of the heat exchanges in the interlinked steam generator is diminished: the steam generator is "carnotised". It can be proved, by calculating the flows of the heat, of the mechaical energy, and of the entropy in the interlinked plants, that the irreversible processes in the air separation plant are accounted for without almost any expenditure of mechanical energy because of this "carnotization".

It has to be clearly understood that practically all the mechanical heat input, generated by the compression of the incoming air feed and by the further compression of the refrigerating cycle air, is recovered in heat accumulator 45 and in air-air heater 898. This recovered heat is used for production of mechanical energy and for generation of steam. Furthermore, throughout all the heat exchanges the nitrogen product and the flue gases are mechanically isolated from each other and do not mix, and the nitrogen product retains its commercial vaue.

The steam produced by steam generator 89, preferably in two banks of tubes, before and after the superheater, is extracted through conduit 20 and is divided into two streams. The major stream passes through conduit 24 to the steam consumers, and the minor stream proceeds by conduit 22 to steam turbine 897. On leaving steam turbine 897, the minor steam stream enters through conduit 21 into the condenser 899, where it condenses. Steam turbine 897 serves for starting purposes and also to help the gas turbine 910 in driving the air compressors 14 and 141 if necessary. The gas turbine 910, the steam turbine 897, and the compressors 14 and 141 can be arranged on one common shaft as is shown in FIG. 2.

The small heat losses in the high-temperature section of the interlinked air separation and steam generation plant can be accounted for by burning some additional fuel in the steam generator 89. Additional air for combustion can enter steam generator 89 through conduit 16, and the additional fuel can be supplied through conduit 15. This additional fuel and air can also serve for starting up the steam generator 89 when the air separation plant and the internally fired gas heater 891 are not yet in operation.

Substantially all the heat of compression of the air is reconverted into mechanical energy or used for the generation of steam in the interlinked air separation-steam generator plant outlined in FIG. 2. As this heat is substantially equivalent to the work carried out by the compressors (excluding losses in the bearings, by radiation and the like), the interlinking system of this invention enables the separation of air into nitrogen and oxygen product to be accomplished almost without energy expenditure.

EXAMPLE 3

Figure 3:
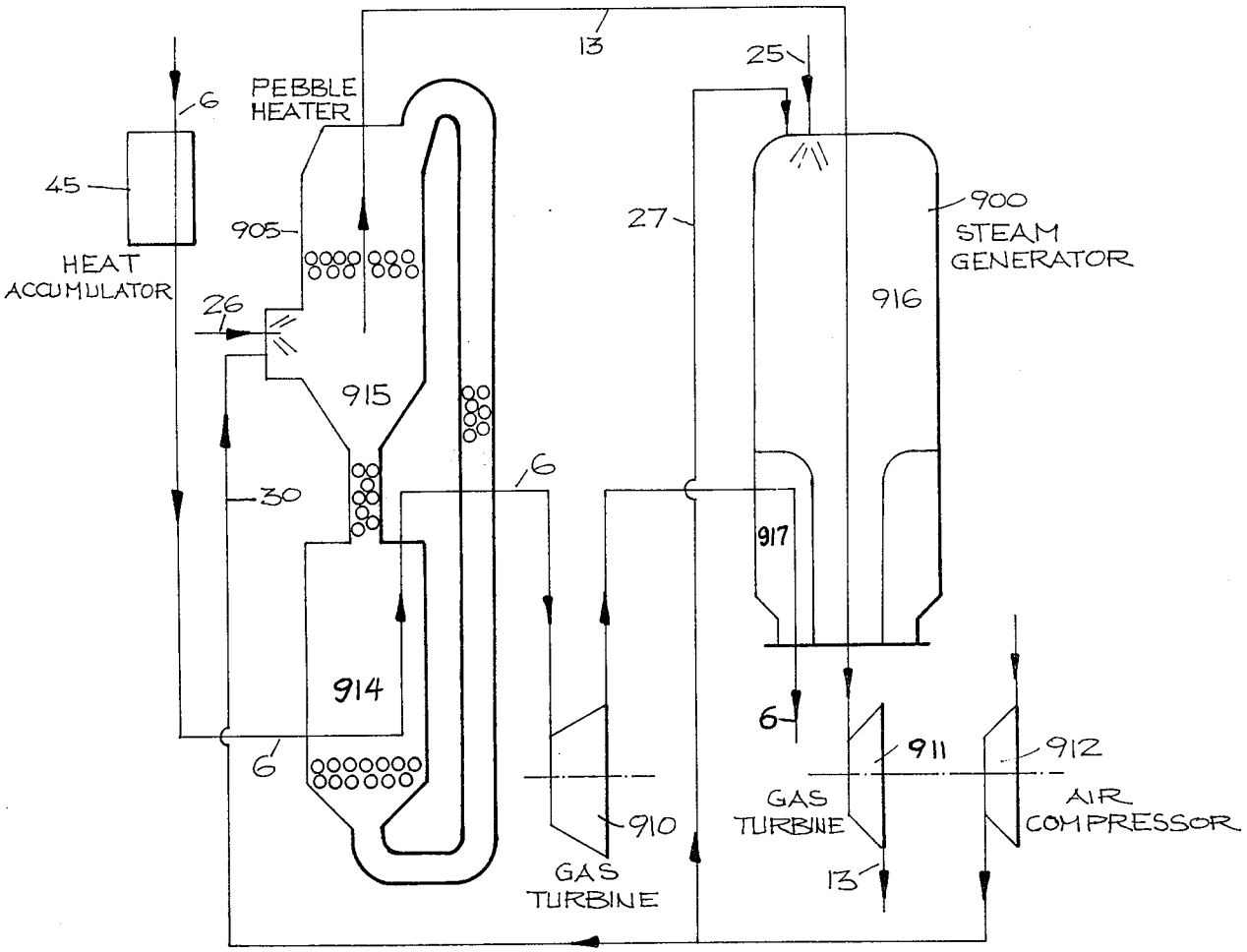
FIG. 3 shows the method of heating the nitrogen product by the flue gases of a pebble heater, the subsequent use of the nitrogen product thereof for production of power and for generation of steam, and the generation of steam by the flue gases of the pebble heater.

Referring to FIG. 3, the pebble heater 905 has two pressurized heating spaces 914 and 915, and the steam generator 900 has one pressurized heating space 916 and one non-pressurized heating space 917. The nitrogen product leaves the heat accumulator 45 through conduit 6 at 400°C. and enters heating space 914 in the pebble heater 905, where it is heated to 1,000°C. The pressure of the flue gases in the pebble heater 905 is approximately equal to the pressure of the nitrogen product, and there is no mixture thereof. After leaving the pebble heater 905, the nitrogen product moves through conduit 6 into the gas turbine 910, where it is work-expanded, and subsequently enters the nonpressurized heating space 917 of the steam generator 900. The flue gases from the pebble heater 905 enter the steam generator 900 through conduit 13 and generate steam in the pressurized heating space 916. The nitrogen product imparts its heat, remaining after its work-expansion in the gas turbine 910, to the heated fluids of the steam generator 900 in the non-pressurized heating space 917.

The flue gases leave the steam generator 900 through conduit 13 and are work-expanded in the gas turbine 911, which drives the combustion air compressor 912. The pressure of the combustion air is 5.2 ata. This combustion air is divided into two streams: the major stream is led into the pebble heater 905 through conduit 30, and the minor stream is led to the steam generator 900 through conduit 27. Fuel is supplied to the pebble heater 905 and steam generator 900 through conduits 26 and 25, respectively.

EXAMPLE 4

Figure 4:
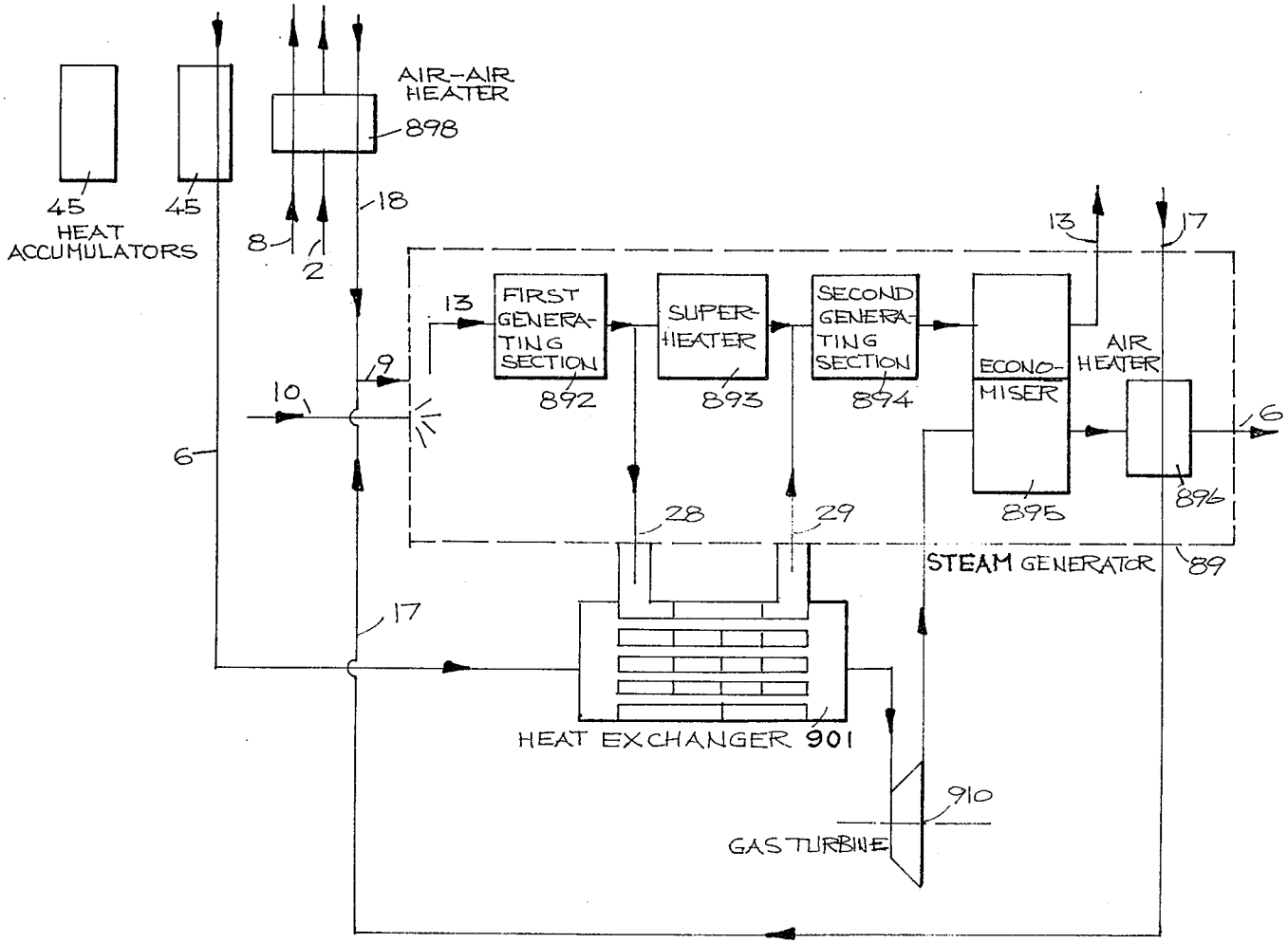
FIG. 4 shows the method of heating the nitrogen product by the flue gases of a steam generator in a heat exchanger made of heat-resisting material, the use of this nitrogen product for the production of power and for the generation of steam, and the generation of steam by flue gases of the steam generator.

Referring to FIG. 4, the nitrogen product leaves the heat accumulator 45 through conduit 6 at a temperature of about 280°C., and enters the heat exchanger 901 made of heat-resisting material, e.g., ceramics. A portion of the flue gases of the steam generator 89 is deflected through duct 28 after the first generating section 892 to enter the heat exchanger 901, where it heats the nitrogen product to about 950°C., and returns through duct 29 to the steam generator 89 before the second generating section 894. This deflected, cooled portion of the flue gases then combines with the rest of the flue gases and participates in the generation of steam.

The nitrogen product leaves the heat exchanger 901 at about 950°C. and work-expands in the gas turbine 910. It then successively enters the economiser 895 of steam generator 89 and the air heater 896, where it respectively imparts its heat, remaining after its work-expansion in the gas turbine 910, to the feed water and air for the combustion of the fuel in the steam generator 89. The nitrogen product and the flue gases undergo the heat exchanges in separate spaces, are mechanically isolated from each other, and retain their chemical composition throughout these heat exchanges.

It will be appreciated that one of the causes of the relatively low efficiency of steam plants is the wide temperature range in which heat is transmitted from the flue gases to the feed water, steam, and air for combustion. As the initial temperature of the flue gases may reach about 2,300°C., while the highest temperature of steam used in present day steam plants reaches 650°C., the irreversibility of the heat transfer is great, and the overall efficiency of the steam plant is correspondingly reduced. However, a pure, dry and non-corrosive gas, such as the nitrogen product from an air separation plant, can enter a gas turbine at temperatures considerably higher than 650°C., and gas turbines driven by gases with inlet temperatures of 1,200°C. and more are known.

In addition, the nitrogen product, after expansion in a gas turbine, can be directed into a steam generator and there impart its remaining heat content to the boiler feed water, steam, and air for the combustion of the fuel, leaving the steam generator at relatively low temperatures because there is no danger of corrosive attack on the components of the steam generator while using the extremely dry nitrogen gas emerging from an air separation plant for heat transfers.

Therefore, by a thermodynamical interlinking of a thermal plant with an air separation plant operating at elevated pressures, a considerable increase in total efficiency can be achieved as set forth hereinbefore by means of indirectly heat exchanging the nitrogen product of the air separation plant with the compressed main air feed for the air separation plant to produce a hot nitrogen product, by further indirectly heat exchanging the hot nitrogen product with a heat source within or connected to the thermal plant to produce a very hot nitrogen product, by work-expanding the very hot nitrogen product, preferably to produce mechanical energy for compression of the main air feed, and finally by indirectly heat-exchanging the work-expanded nitrogen product with the incoming heated fluids for the thermal plant until the nitrogen product leaves the interlinked plants at a temperature close to ambient (and in uncontaminated condition) whereby irreversibility of heat exchanging within the thermal plant is considerably lessened.

The layouts shown by FIGS. 1 through 4 are merely exemplary embodiments of the present invention. Thus, not all the nitrogen product may be heated and used for work-expansion, and other types of equipment may be used (e.g., heat exchangers different than the Frankl type can be employed for heat exchanges between the incoming air feed and the nitrogen product).

Whereas many modifications of the invention, which have been shown and described hereinbefore in four preferred embodiments, may be made by one skilled in the art without departing from the spirit of this invention, it is desired to protect by Letters Patent all forms of the invention falling within the following claims when broadly construed.

What is claimed is:

1. In double fractionation of air at low temperatures in an air separation plant, operating at elevated pressures on a compressed main air feed and producing a nitrogen product, the method for thermodynamically interlinking said air separation plant with a steam generator so that irreversibility of heat transfer within said steam generator is reduced and total efficiency of said interlinked plants is increased, consisting essentially of:

A. accumulatively and indirectly heating said nitrogen product with said compressed main air feed to form a hot nitrogen product containing a low-grade heat;

B. indirectly heating said hot nitrogen product with high-grade heat generated by combusting an air-fuel mixture to form combustion products at a high temperature level in connection with said steam generator, without contaminating said nitrogen product with said combustion products, to form a very hot nitrogen product;

B'. preheating at least a portion of the air of the air-fuel mixture by indirect heat exchange with a portion of said compressed main air feed prior to any further heat exchange;

C. work-expanding said very hot nitrogen product to obtain energy therefrom and cool said nitrogen product to a lower temperature level;

D. indirectly cooling said work-expanded nitrogen product to a temperature that is close to ambient by transferring low-grade heat within said steam generator; and E. disposing of said cooled nitrogen product, uncontaminated by said combustion products, outside of said interlinked plants.

2. The method of claim 1 wherein said high temperature level is above about 1,200°C. and said lower temperature level is at about 880°C.

3. The method of claim 2 wherein said low-grade heat is transferred to the water and combustion air which are fed to said steam generator.

4. The method of claim 1 wherein said energy obtained by work-expanding said very hot nitrogen product is mechanical energy which is used for compressing said main air feed.

5. The method of claim 4 wherein said very hot nitrogen product is work-expanded in a gas turbine which is mechanically connected to a compressor for compressing said main air feed.

6. The method of claim 1 wherein said high-grade heat is supplied through a heat exchanger made of heat-resisting material and heated with flue gases.

7. The method of claim 6 wherein said hot nitrogen product is at about 280°C. and said very hot nitrogen product is at about 950°C.

8. The method of claim 7 wherein said heat-resisting material is a ceramic and said flue gases are supplied from the superheater region of said steam generator.

9. In double fractionation of air at low temperatures in an air separation plant, comprising a fractionating column with a high pressure zone and an intermediate pressure zone and operating at elevated pressures to produce a relatively pure nitrogen product and a relatively pure oxygen products, wherein said high pressure zone operates at a pressure higher than 9 ata but lower than 25 ata, and said intermediate pressure zone operates at a pressure higher than 1.5 ata but lower than 9 ata, and wherein an incoming air stream is compressed to more than 9 ata as a main air feed before its separation, an improvement consisting essentially of thermodynamically interlinking said air separation plant with a steam generator and thereby carnotizing said steam generator, essentially by means of indirect heat exchanges between said nitrogen product and the heating fluids and the heated fluids of said steam generator, said indirect heat exchanges comprising:

A. countercurrently and indirectly exchanging low-grade heat from said compressed main air feed to at least part of said nitrogen product;

B. indirectly exchanging high-grade heat from said heating fluids of said steam generator to said at least part of said nitrogen product;

C. work-expanding said at least part of said nitrogen product; and

D. indirectly exchanging low-grade heat from said work-expanded said at least part of said nitrogen product to said heated fluids, thus recovering at least a substantial part of mechanical energy required for the compression of said incoming air stream without substantially impairing the efficiency of said steam generator.

10. The improvement according to claim 9, wherein said fractionation column further comprises a feed and a reflux from said high pressure zone to said intermediate pressure zone and wherein said relatively pure oxygen and nitrogen products are obtained by increasing the reflux quantity to said intermediate pressure zone by the following steps:

A. throttling at least part of said oxygen product in liquid phase from said intermediate pressure to a lower pressure so as to reduce its temperature and form a throttled oxygen product; and B. carrying out an indirect heat exchange between said throttled oxygen product and said feed and said reflux from said high pressure zone so as to subcool said feed and said reflux to such an extent that their partial evaporation during said throttling is minimized.

11. The improvement according to claim 9, wherein part of said incoming air stream is compressed to a pressure higher than 100 ata, cooled, work-expanded, and led to said high pressure zone of said fractionating column as part of said compressed main air feed.

12. The improvement according to claim 9, wherein said nitrogen product is heated to well above 600°C. by the flue gases of a pebble heater, and wherein said steam generator, which is interlinked with said air separation plant, is provided with one pressurized and one non-pressurized heating space, said flue gases from said pebble heater and said work-expanded nitrogen product imparting heat to said heated fluids of said steam generator in said pressurized and non-pressurized spaces, respectively.

13. The improvement according to claim 10, wherein said nitrogen product is heated to well above 600°C. in a heat exchanger made of heat-resisting material by the flue gases of said steam generator, and wherein said flue gases, before they enter said heat exchanger, impart some of their high temperature heat to the heated fluids of said steam generator.

14. The improvement according to claim 10, wherein substantially all the heat which is generated by the compression of said incoming air stream to form said compressed main air feed is imparted to said nitrogen product and to at least one said heated fluid of said steam generator.

15. In double fractionation of air at low temperatures and elevated pressures in a high-prssure zone and in an intermediate-pressure zone of an air separation plant to produce a relatively pure oxygen product and a relatively pure nitrogen product, after compression of said air, wherein said high pressure zone operates at a high pressure higher than 9 ata but lower than 25 ata and said intermediate-pressure zone operates at an intermediate pressure higher than 1.5 ata but lower than 9 ata, an improvement to recover most of the energy required for said compression by interlinking said air separation plant with a steam generator using flue gas for steam generation, consisting essentially of the following steps:

A. forming a compressed main air feed by compressing said air to said high pressure, without intercooling thereof that would remove relatively low-temperature compression heat generated by said compressing, and dividing said compressed main air feed into a major part and a remaining part;

B. transferring, by indirect heat exchange, said relatively low-temperature compression heat from said major part of said compressed main air feed to said nitrogen product so that the temperature of said nitrogen product is raised to form a hot nitrogen product;

C. transferring, by indirect exchange therebetween, said relatively low-temperature compression heat from said remaining part of said compressed main air feed to at least one heated fluid feed for said steam generator;

D. transferring, by indirect exchange therebetween, a quantity of high-temperature heat from said flue gas to said hot nitrogen product, so that the temperature of said hot nitorgen product is raised additionally and a very hot nitrogen product having a temperature well above 600°C. is formed;

E. work-expanding said very hot nitrogen product in a gas turbine to obtain mechanical energy therefrom and to cool said very hot nitrogen product so that a work-expanded nitrogen product having a lower temperature is formed, said mechanical energy being used for said compressing of said air in step A; and F. transferring, by indirect exchange therebetween, heat at said lower temperature from said work-expanded nitrogen product to at least one heated fluid feed to said steam generator to decrease said lower temperature to an exit temperature well below 150°C. and to form a cooled nitrogen product having essentially no other contaminants than said relatively pure nitrogen product and without augmenting the volume of said nitrogen product by admixing it with said flue gas, whereby wastage of said relatively low-temperature compression heat generated by said compression is essentially avoided, a quantity of high-temperature heat is borrowed from said flue gas which is at a temperature substantially hotter than the critical temperature of steam, said high-temperature heat is used for production of mechanical energy, and essentially said quantity of heat is returned at said lower temperature to said at least one heated fluid, the efficiency of said steam generator not being substantially reduced.

16. The method of claim 15 wherein said high-pressure zone is at a pressure of about 15 ata and said intermediate-pressure zone is at a pressure of about 5 ata.

17. The method of claim 16 wherein said intermediate-pressure zone is operated at reflux in order to obtain products of relatively high purity and wherein the reflux ratio therefor is increased by undercooling of feed and reflux from said high-pressure zone to said intermediate-pressure zone.

18. The method of claim 17 wherein a part of said oxygen product is throttled from 5 ata to 1.1 ata to reduce its its temperature and is then heat-exchanged with the feed and reflux streams to said intermediate-pressure zone so that said feed ad reflux zones are respectively subcooled to 98°K and 99°K, thereby substantially eliminating partial evaporation of said feed and reflux during throttling from 15 ata to 5 ata in said intermediate-pressure zone.

19. The method of claim 15 wherein said very hot nitrogen product is at approximately 1,290°C.

20. The method of claim 15 wherein a small portion of said compressed main air feed, after said heat-exchanging to form said hot nitrogen product, is compressed further to form highly compressed refrigerating cycle air.

21. The method of claim 20 wherein said highly compressed refrigerating cycle air is heat-exchanged with combustion air for said steam generator and thereby partially cooled.

22. The method of claim 21 wherein said partially cooled air is further cooled, work-expanded, and fed into said high-pressure zone.

23. The method of claim 15 wherein a minor portion of said compressed main air feed, prior to said heat-exchanging to form said hot nitrogen product, is heat-exchanged with combustion air, additionally cooled, and combined with the remainder of said compressed main air feed.

24. The method of claim 15 wherein said steam generator is combind with a pebble heater having a pressurized heating space in which said hot nitrogen product is indirectly heat-exchanged with flue gases.

25. The method of claim 24 wherein said hot nitrogen product enters said pebble heater at approximately 400°C. and is heated to approximately 1,000°C. therein.

26. The method of claim 25 wherein said flue gases are used for generating steam in said steam generator.

27. In the simultaneous operation of a steam generator and an air separation plant as two separate and distinct closed systems, in which said steam generator has heated fluids as feeds therefor and a source of high-temperature heat generated by combusting an air-fuel mixture to form flue gases as combustion products and in which said air separation plant operates at elevated pressures on a compressed main air feed and produces a relatively pure nitrogen product, the improvement consisting essentially of the thermodynamic interlinking of said steam generator and said air separation plant through solely indirect heaat exchanges to produce mechanical energy by sequentially heating and work-expanding said nitrogen product without substantially impairing the efficiency of said steam generator, said indirect heat exchanges comprising:

A. transferring, by indirect heat exchange therebetween, a quantity of relatively low-temperature compression heat from said compressed main air feed to said nitrogen product so that the temperature of said nitrogen product is raised to form a hot nitrogen product;

B. transferring, by indirect heat exchange therebetween, a quantity of said high-temperature heat from said flue gases to said hot nitrogen product, so that the temperature of said hot nitrogen product is raised additionally and a very hot nitrogen product having a temperature well above 600°C. is formed;

C. after said work expanding said very hot nitrogen product in a gas turbine to obtain said mechanical energy therefrom so that a work-expanded nitrogen product having a lower temperature is formed, transferring, by indirect heat exchange therebetween, a quantity of heat at said lower temperature from said work-expanded nitrogen product to at least one of said heated fluids to decrease said lower temperature to an exit temperature below 150°C. and to form a cooled nitrogen product having essentially no other contaminants than sad relatively pure nitrogen product and without augmenting the volume of said nitrogen product by admixing it with said flue gases.

28. The improvement according to claim 27, wherein an incoming air stream is compressed to a pressure higher than 9 ata to form said compressed main air feed and wherein said air separation plant comprises a fractioning column having a high pressure zone, operating at a high pressure higher than 9 ata but lower than 25 ata, and an intermediate pressure zone, operating at an intermediate pressure higher than 1.5 ata but lower than 9 ata, to produce said relatively pure nitrogen product and a relatively pure oxygen product.

* * * * *